US005894877A

United States Patent [19]

Sommerfeld

[11] Patent Number: 5,894,877

[45] Date of Patent: Apr. 20, 1999

[54] VERTICAL BLIND

[75] Inventor: Dean R. Sommerfeld, Cottage Grove, Wis.

[73] Assignee: Springs Window Fashions Division, Inc., Middleton, Wis.

[21] Appl. No.: 08/512,477

[22] Filed: Aug. 8, 1995

Related U.S. Application Data

[63] Continuation-in-part of application No. 08/243,124, May 16, 1994, abandoned.

[51] Int. Cl.[6] ..... E06B 9/36

[52] U.S. Cl. ..... 160/168.1 V; 160/176.1 V; 160/177 V

[58] Field of Search ..... 160/168.1 V, 176.1 V, 160/900, 177 V; 74/427

[56] References Cited

U.S. PATENT DOCUMENTS 4,122,884 10/1978 Salzmann .
4,214,622 7/1980 Debs .
4,291,738 9/1981 Grenga et al. .
4,316,493 2/1982 Arena .
4,848,435 7/1989 Helver .
4,875,516 10/1989 Marocco ..... 160/178.1 R
5,090,267 2/1992 Gramling ..... 74/427

FOREIGN PATENT DOCUMENTS 2060743 5/1981 United Kingdom .

*Primary Examiner*—Blair M. Johnson
*Attorney, Agent, or Firm*—Vernon J. Pillote

[57] ABSTRACT

A vertical blind apparatus having a wand operated control for traversing the slats along a headrail and for rotating the slats. The blind apparatus has an actuator shaft with its axis disposed in a central vertical plane equidistant from the sidewalls of the headrail; slat carriers are mounted on slat carriages for rotation about vertical axes disposed in the central vertical plane and a control shaft for the wand operated control is also mounted for rotation in the central vertical plane. The wand operated vertical blind apparatus can be used in either left or right draw installations and in two-way draw installations.

14 Claims, 3 Drawing Sheets

FIG. 1
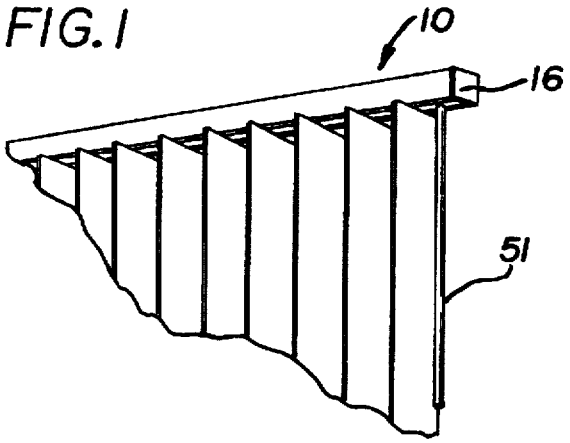
FIG. 2
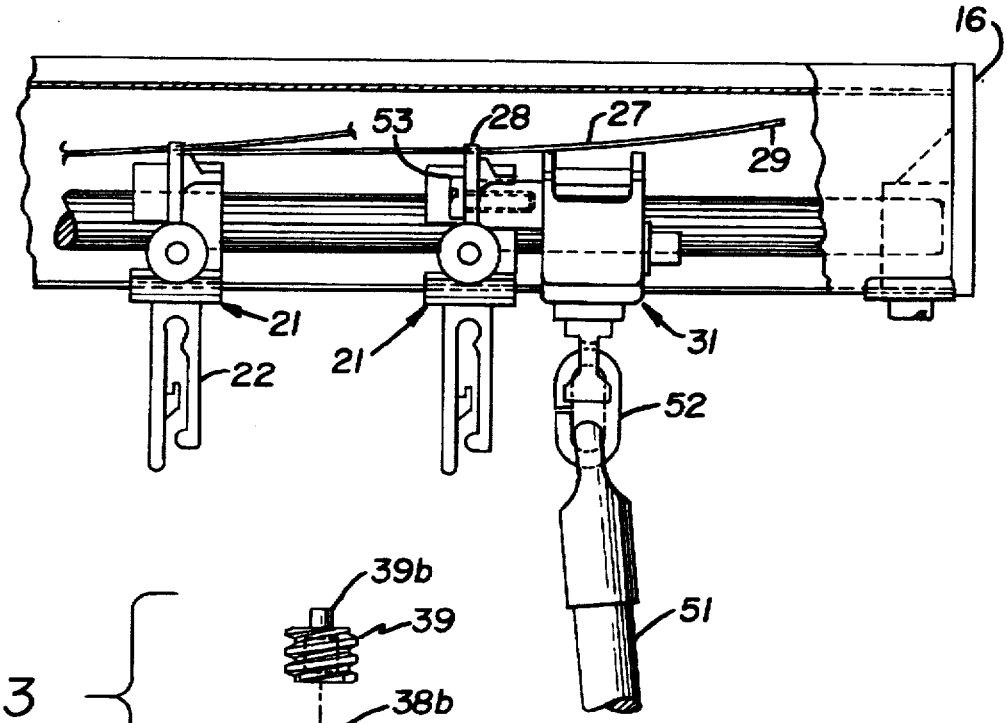
FIG. 3
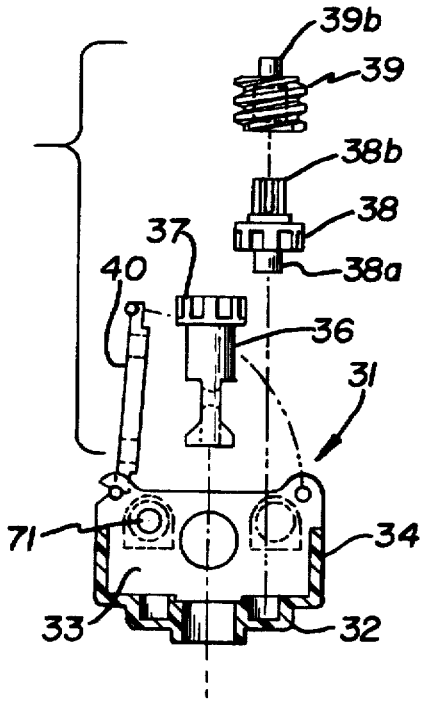
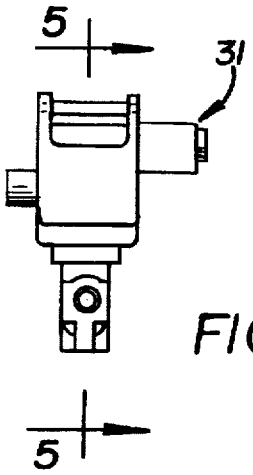
FIG. 4

FIG. 7
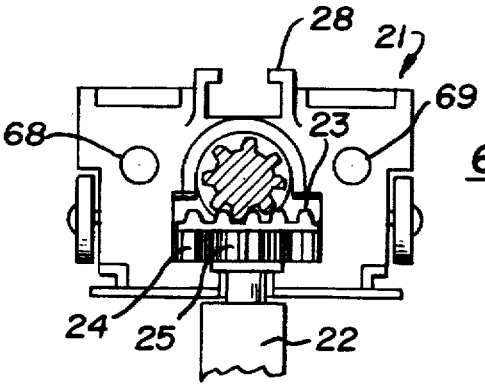
FIG. 5
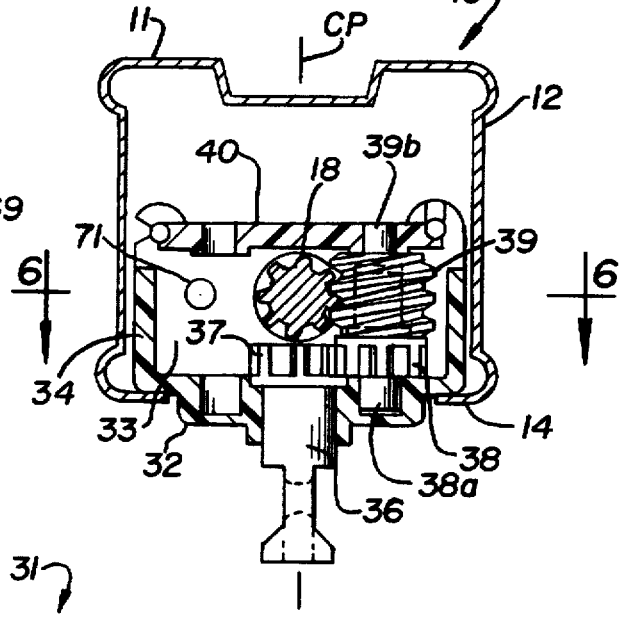
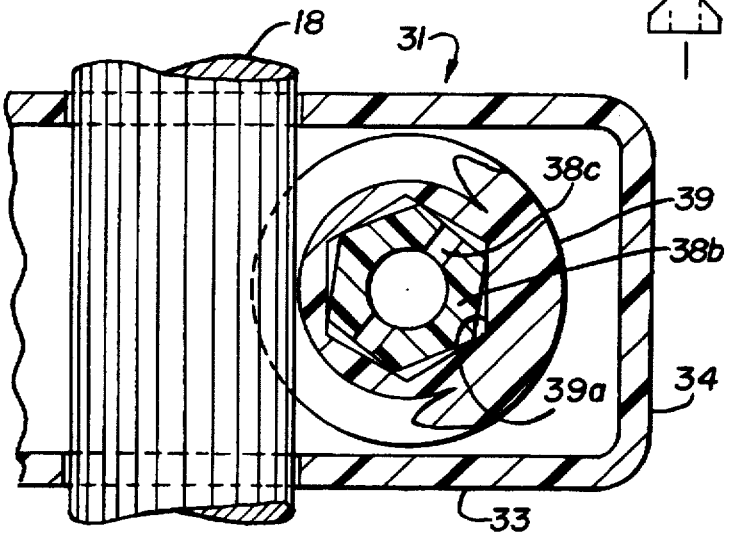
FIG. 6
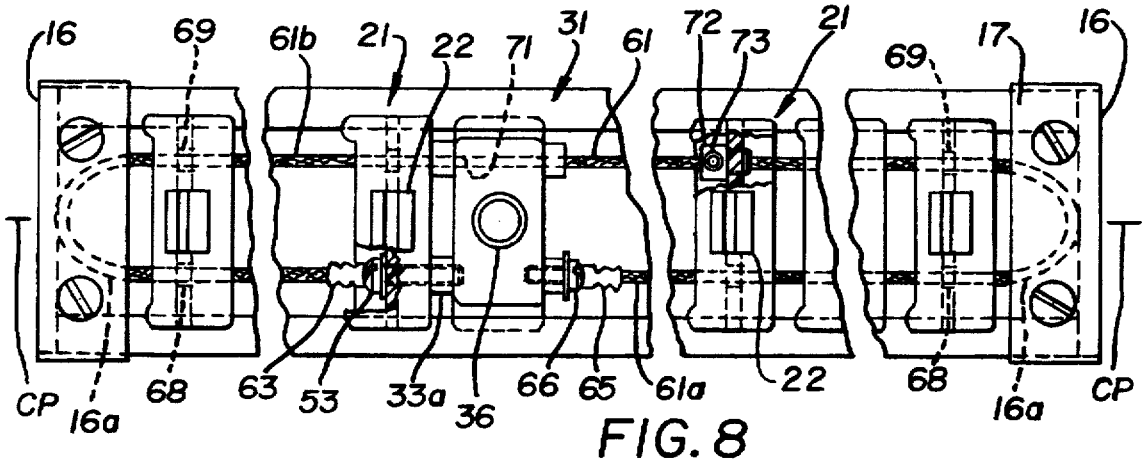
FIG. 8

VERTICAL BLIND

CROSS-REFERENCE TO RELATED APPLICATIONS

This application is a continuation-in-part of the application of Dean R. Sommerfeld, Ser. No. 08/243,124, filed May 16, 1994 for "Vertical Blind", now abandoned.

BACKGROUND OF THE INVENTION

It has heretofore been proposed as disclosed in U.S. Pat. Nos. 4,316,493 and 4,214,622, to make a vertical venetian blind with a wand type operator arranged so that pulling the wand operator lengthwise of the headrail effects traversing of the slat carriages along the headrail and rotation of the wand at any point along the headrail effected turning of the vertical blind slats. In the above patents, the slat carriers and the axis of rotation of the wand connection to the rotation control is offset from a central vertical plane through the headrail so that it was necessary to assemble the slat carriages and control carriage in one arrangement for use in installations in which the slats would stack at the left and in a different arrangement for installations in which the slats would stack at the right. In the '493 patent, the slat carriers were also rotatable about axes disposed in a different longitudinal plane than the wand control shaft such that the wand control shaft would interfere with closing of the slats in one direction.

SUMMARY OF THE INVENTION

It is an object of the present invention to provide a vertical blind assembly having a wand operated control for rotating and traversing the blind slats and in which the same blind assembly can be used in one-way draw installations that stack either to the left or to the right.

It is another object of the present invention to provide a vertical venetian blind having a wand operated control which can be used in two-way draw installations.

BRIEF DESCRIPTION OF THE DRAWINGS

FIG. 1 is a fragmentary perspective view of the vertical blind assembly embodying the present invention;

FIG. 2 is a fragmentary longitudinal sectional view through the vertical blind assembly;

FIG. 3 is an exploded view illustrating assembly of the control carriage;

FIG. 4 is a side elevational view of the control carriage;

FIG. 5 is a transverse sectional view through the headrail and control carriage taken on the plane 5—5 of FIG. 4 and illustrating parts on a larger scale than FIG. 4;

FIG. 6 is a fragmentary horizontal sectional view taken on the plane 6—6 of FIG. 5 and illustrating parts on a larger scale than FIG. 5;

FIG. 7 is a side view of a slat carriage;

FIG. 8 is a bottom view of a vertical blind with a wand operated control for traversing and rotating the slats and arranged for two-way draw;

DETAILED DESCRIPTION

Figure 9:
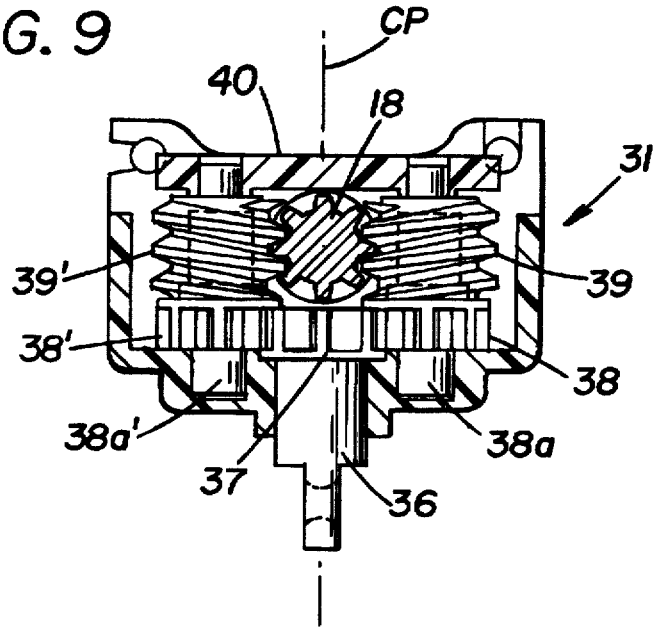
FIG. 9 is a sectional view through a modified form of control carriage.

The venetian blind includes a headrail 10 having a top wall 11, opposed sidewalls 12, and lengthwise extending rails 14 on the sidewalls. End caps are mounted at opposite ends of the headrail as by clamp plates 17 and an actuator shaft 18 is rotatably supported in the end caps for rotation about an axis extending lengthwise of the headrail and disposed in a central vertical plane designated CP that extends longitudinally of the headrail substantially equidistant from the sidewalls 12.

A plurality of slat carriages 21 are mounted on the rails 14 for movement along the headrail. Each slat carriage carrier has a slat carrier 22 mounted for rotation about an upright axis disposed in the central vertical plane CP and gear means for rotating the slat carriers in response to turning movement of the actuator shaft 18. In the embodiments illustrated, actuator shaft is provided with gear teeth on the outer periphery and the gear carrier means is of the rack and pinion type disclosed in U.S. Pat. No. 4,122,884. As best shown in FIG. 7, the carrier gear means includes a rack member 23 having a vertical row of gear teeth that mesh with gear teeth on the actuator shaft 18, and a horizontal row of gear teeth 24 that mesh with a pinion gear 25 on the upper end of the slat carriers. As is conventional, slat spacer means are also provided for controlling the spacing between the carriages. In the embodiments illustrated, the slat spacing means comprises spacer links 27 (FIG. 2) connected to each carriage and which are slidably received in guides 28 on an adjacent carriage. The spacer links allow the slat carriages to move into closely spaced relation for compact stacking and have a head 29 at a distal end to limit maximum spacing between adjacent slat carriages when the blind is extended. As is known to those skilled in the art, the slat spacer means can also be of the pantograph type.

A wand operated control carriage 31 is mounted on the rails 14 and, as best shown in FIGS. 3 and 5, the control carriage has a bottom wall 32 and spaced side and end walls 33 and 34. A control shaft 36 is mounted in the bottom wall for rotation about an upright axis disposed in the central vertical blind CP and gear means are provided for drivingly connecting the control shaft to the actuator shaft 18 with a high turn reduction ratio preferably of the order of 8 to 1, to facilitate accurate adjustment of the slat angle and to reduce inadvertent turning of the slats when drawing the control carriage along the headrail. As best shown in FIG. 5, a first spur gear 37 mounted for rotation with the control shaft 36 and meshes with a second spur gear 38 supported for rotation about an upright axis offset to one side of the central vertical plane CP and which second spur gear drives a worm gear 39 which rotates the actuator shaft. The spur gear 37 is preferably formed integrally with the upper end of the actuator shaft 36 and the second spur gear has a trunnion **38*a* on its lower end and is rotatably supported in the bottom wall 32 of the control carriage. A slip clutch connection is advantageously provided between the spur gear 38 and the worm gear 39 and, as shown in FIG. 6, the spur gear 38 is formed with an upwardly extending multisided post 38*b* with one or more longitudinal slots 38*c* to facilitate radial compression of the post, and the post is received in a complimentary multi-sided socket 39*a* in the worm gear 39. The clearances between the post 38*b* and socket 39*a* are selected in relation with the resilience of the material to provide sufficient driving torque for rotating the slats during normal operation, and which will yield or slip to prevent transmitting excessive torque to the worm gear and possible stripping of the teeth on the worm gear. The upper end of the worm gear is formed with a pintle 39*b* that is rotatably supported in cover plate 40 detachably secured to the sidewalls 33 of the control carrier. In the preferred embodiment illustrated, the actuator shaft 18 is formed with longitudinally extending splines that define longitudinally extending gear teeth and the worm gear 39** is constructed and arranged to mesh with the gear teeth on the actuator shaft.

An operating wand 51 is drivingly and swivelly connected to the control shaft 36 as by a link 52 such that axial rotation of the wand effects rotation of the actuator shaft 18 through gears 37, 38 and 39, and pulling on the wand in a direction having a substantial component lengthwise of the headrail draws the control carriage 31 lengthwise along the headrail. As best shown in FIG. 2, the control carriage 31 is operatively connected to a lead one of the slat carriages 21 as by a screw fastener 53 (FIG. 2) that extends through a lead one of slat carriers and into a boss 33a on one of the sidewalls 33 of the control carriage. Thus, when the control carriage is moved along the headrail in one direction, it draws the lead slat carriage and the carriage spacer control means herein shown as links 27 draw the other slat carriages along the headrail and control the spacing therebetween. Conversely, when the control carriage is moved in the other direction, the carriage spacer control links allow the carriages to move into abutting relation to a stacked condition.

The wand can be turned to rotate the slats when the slats are in at least a partially extended condition. Since the control shaft 36 is disposed in the same vertical plane as the axis of rotation of the slat carriers 22, the control shaft does not interfere with rotation of the slats to a closed position in either direction. Further, since the axis of rotation of the slat carriers and the axis of rotation of the control shaft are disposed in the central vertical plane CP that is medially between the sides 12 of the headrail, the wand controlled vertical blind assembly can be used for either a left or a right hand draw without any changes.

The wand control vertical blind apparatus of the present invention is also adapted for use in two-way draw installations with a single wand. As shown in FIG. 8, one group of slat carriages 21 is disposed between the control carriage 31 and one end of the headrail, and a second group of slat carriages is disposed between the control carriage and the other end of the headrail. Cord returns such as U-shaped guide passages 16*a* or pulleys are provided in the end members 16 and a traverse cord-means 61 is arranged in a loop having first and second runs 61*a* and 61*b* that extend between cord returns 16*a*. Means are provided for connecting the first run 61*a* to the control carriage 32 for movement thereby and means are provided for connecting the second run 61*b* of the traverse cord means to a lead one of the carriages of the second group, for movement by the traverse cord means. In the embodiment shown, one end of the cord loop is attached as by a connector 63 and fastener 53 to the auxiliary carriage 32 and the other end of the traverse cord loop is attached as by a connector 65 and fastener 66 to the control carriage at a second side of the latter. The slat carriages have cord openings 68 and 69 therethrough at opposite sides of the central vertical plane CP. The first run 61*a* of the traverse cord means extends from the control carriage at one side of the central vertical plane through cord openings in both groups of slat carriers and through the cord return means 16*a* and the second run 61*b* of the traverse cord loop extends at the other side of the central vertical plane through cord openings in both groups of slat carriers and is anchored to the lead slat carriage of the second group by a fitting 72. The cord run 61*b* is arranged so that it can slide past the control carriage and may, for example, be arranged to slide through a suitably located opening 71 in the control carriage or arranged to pass over the top of the control carriage. The fitting for anchoring the traverse cord to the second auxiliary slat carriage is preferably arranged so that a cord can pass therethrough and normally allow relative movement between the traverse cord and the second lead carriage for adjustment of the latter, and which has a locking means such as a screw 73 to lock the lead carriage to the run 61*b* of the traverse cord when the lead carriage has been adjusted to a position such that the second lead slat carriage and the control carriage meet at substantially the longitudinal center of the headrail. The slat carriages and control support the actuator shaft and traverse cords when the blind is in a closed position. As will be readily understood by those skilled in the art, auxiliary shaft supports (not shown) can be provided for supporting the actuator shaft and traverse cord runs in long headrails when the slat carriages are moved to an open position.

Figure 10:
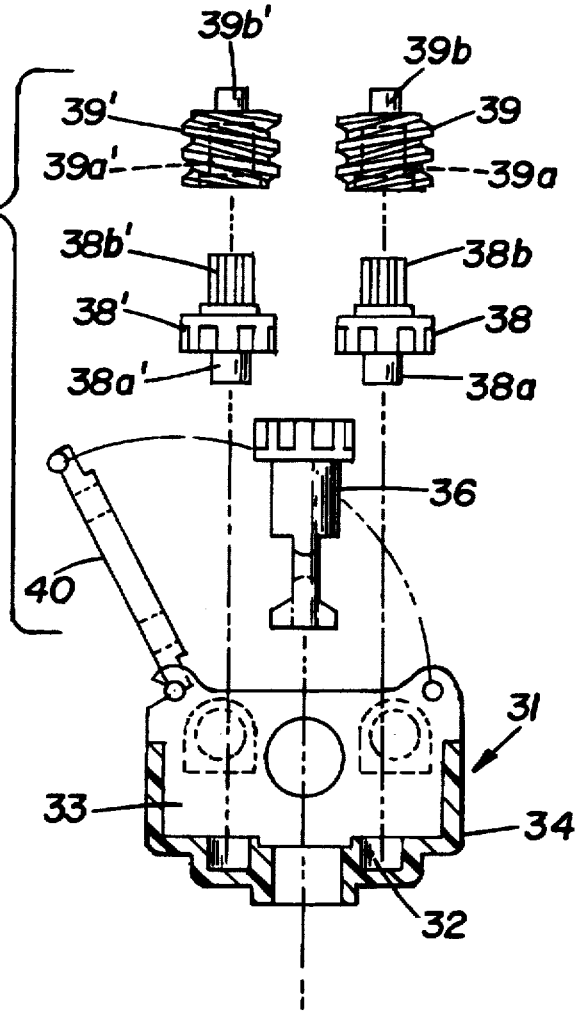
FIG. 10 is an exploded view of the control carriage of FIG. 9.

The embodiment illustrated in FIGS. 9 and 10 is generally the same as in FIGS. 1–8 and like numerals are used to designate the same parts and like numerals followed by the postscript' are used to designate modified parts. In this embodiment, a first spur gear 37 is mounted for rotation with the control shaft 36 and meshes with second and third spur gears 38, 38' supported for rotation about an upright axes offset from first and second sides of the central vertical plane CP and the second and third spur gears respectively drive worm gears 39 and 39'. Spur gear 36 rotates spur gears 38 and 39 in relatively opposite directions and the threads on the worm gears 39, 39' are of opposite hand, herein illustrated as right hand and left hand respectively so that both worm gears will rotate the actuator shaft 18 in the same direction in response to turning of the control shaft 36. The spur gear 37 is preferably formed integrally with the upper end of the control shaft 36 and the second and third spur gears each have a trunnion 38*a*, 38*a*' on their lower ends and are rotatably supported in the bottom wall 32 of the control carriage. As in the preceding embodiment, a slip clutch connection is advantageously provided between the spur gears 38, 38' and the worm gears 39, 39' and, as shown in FIG. 10, the spur gears 38, 38' are formed with upwardly extending multi-sided posts 38*b*, 38*b*', with one or more longitudinal slots 38*c* to facilitate radial compression of the post, and the posts are received in complimentary multi-sided sockets 39*a*, 39*a*' in the worm gears 39, 39'. The clearances between the posts and sockets are selected in relation with the resilience of the material to provide sufficient driving torque for rotating the slats during normal operation, and which will yield or slip to prevent transmitting excessive torque to the worm gears and possible stripping of the teeth on the worm gear. The upper end of the worm gears are formed with pintles 39*b*, 39*b*' that are rotatably supported in cover plate 40 detachably secured to the sidewalls 33 of the control carrier. In the embodiments illustrated, the actuator shaft 18 is formed with longitudinally extending splines that define longitudinally extending gear teeth and the worm gears 39' are constructed and arranged to mesh with the gear teeth on the actuator shaft.

The operating wand 51 is drivingly and swivelly connected to the control shaft 36 as described in connection with FIGS. 1–8 and axial rotation of the wand effects rotation of the actuator shaft 18 through gears 37, 38, 38' and 39' and the control carriage is connected to a lead one of the slat carriages so that pulling or pushing the wand in a direction having a substantial component lengthwise of the headrail moves the control carriage 31 lengthwise along the headrail.

In the control carriage and gear arrangement shown in FIGS. 9 and 10, the worm gears 39, 39' are disposed at opposite sides of the actuator shaft 18 and have threads of opposite hand for rotating the actuator shaft. This arrangement reduces the drive loads on the teeth of the spur gears 38, 38', worm gears 39, 39' and drive gears 37 and consequently reduces tooth wear and the likelihood of tooth breakage. The dual worm gear drive also enables use of two slip clutches and allows better control of the amount of force required to safely clutch the drive unit. Further, this arrangement is such that forces exerted by the worm gears 39, 39' on the actuator shaft 18 in a direction crosswise of the central plane CP, are opposed and substantially balanced so that lateral deflection of the actuator shaft is minimized. It has also been found that the dual worm drive provides smooth rotation of the actuator shaft. The control carriage illustrated in FIGS. 9 and 10 is the presently preferred embodiment.

The embodiments of the invention in which an exclusive property or privilege is claimed are defined as follows:

1. A vertical blind apparatus including an elongated headrail having lengthwise extending sidewalls spaced substantially equidistant from a central vertical plane and guide rails on the sidewalls, a horizontally extending actuator shaft means rotatably mounted on the headrail with its axis in said central vertical plane, a plurality of slat carriages mounted on the guide rails for movement therealong and a slat carrier mounted on each slat carriage for turning relative thereto about a vertical axis disposed in said central vertical plane, means on the slat carriages for turning the slat carriers in response to turning of the actuator shaft, operating means for traversing the slat carriages along the headrail and for turning the slat carriers, the operating means including a control carriage mounted on the guide rails for movement along the headrail and having a control shaft mounted thereon for rotation about a first upright axis disposed in said central vertical plane, carriage traverse means for traversing the slat carriages along the headrail in response to movement of the control carriage, a first spur gear on the upper end of said control shaft, a second spur gear meshing with said first spur gear and mounted on the control carriage for axial rotation about a second upright axis parallel to said first upright axis and spaced from a first side of said central vertical plane, a worm gear connected to said second spur gear in coaxial relation therewith for rotating the actuator shaft, and a wand connected to said control shaft for rotating the control shaft and for drawing the control carriage along the headrail.

2. A vertical blind apparatus according to claim 1 including slip clutch means for drivingly connecting said second spur gear to said worm gear.

3. A vertical blind apparatus including an elongated headrail having lengthwise extending sidewalls spaced substantially equidistant from a central vertical plane and guide rails on the sidewalls, a horizontally extending actuator shaft rotatably mounted on the headrail with its axis in said central vertical plane, the actuator shaft having external splines defining longitudinally extending gear teeth, a plurality of slat carriages mounted on the guide rails for movement therealong and a slat carrier mounted on each slat carriage for turning relative thereto about a vertical axis disposed in said central vertical plane, means on the slat carriages for turning the slat carriers in response to turning of the actuator shaft, operating means for traversing the slat carriages along the headrail and for turning the slat carriers, the operating means including a control carriage mounted on the guide rails for movement along the headrail and having a control shaft mounted thereon for rotation about a first upright axis disposed in said central vertical plane, carriage traverse means for traversing the slat carriages along the headrail in response to movement of the control carriage, a first spur gear on the upper end of said control shaft, a second spur gear meshing with said first spur gear and mounted on the control carriage for axial rotation about a second upright axis parallel to said first upright axis and spaced from a first side of said central vertical plane, a worm gear connected to said second spur gear in coaxial relation therewith and meshing with the gear teeth on the actuator shaft for rotating the actuator shaft, and a wand connected to said control shaft for rotating the control shaft and for drawing the control carriage along the headrail.

4. A vertical blind apparatus including an elongated headrail having lengthwise extending sidewalls spaced substantially equidistant from a central vertical plane and guide rails on the sidewalls, a horizontally extending actuator shaft means rotatably mounted on the headrail with its axis in said central vertical plane, a plurality of slat carriages mounted on the guide rails for movement therealong and a slat carrier mounted on each slat carriage for turning relative thereto about a vertical axis disposed in said central vertical plane, means on the slat carriages for turning the slat carriers in response to turning of the actuator shaft means, operating means for traversing the slat carriages along the headrail and for turning the slat carriers, the operating means including a control carriage mounted on the guide rails for movement along the headrail and having a control shaft mounted thereon for rotation about a first upright axis disposed in said central vertical plane, carriage traverse means for traversing the slat carriages along the headrail in response to movement of the control carriage, a first spur gear on the upper end of said control shaft, a second spur gear meshing with said first spur gear and mounted on the control carriage for axial rotation about a second upright axis parallel to said first upright axis and spaced from a first side of said central vertical plane, a worm gear in coaxial relation with said second spur gear for rotating the actuator shaft means, slip clutch means for drivingly connecting the second spur gear to the worm gear, a wand connected to said control shaft for rotating the control shaft and for drawing the control carriage along the headrail, said slip-clutch means including a pocket of non-circular cross-section in said worm gear and a stem of non-circular cross-section on the second spur gear extending into the socket on the worm gear.

5. A vertical blind apparatus including an elongated headrail having lengthwise extending sidewalls spaced substantially equidistant from a central vertical plane and guide rails on the sidewalls, a horizontally extending actuator shaft rotatably mounted on the headrail with its axis in said central vertical plane, a plurality of slat carriages mounted on the guide rails for movement therealong and a slat carrier mounted on each slat carriage for turning relative thereto about a vertical axis disposed in said central vertical plane, means on the slat carriages for turning the slat carriers in response to turning of the actuator shaft, operating means for traversing the slat carriages along the headrail and for turning the slat carriers, the operating means including a control carriage mounted on the guide rails for movement along the headrail and having a control shaft mounted thereon for rotation about a first upright axis disposed in said central vertical plane, carriage traverse means for traversing the slat carriages along the headrail in response to movement of the control carriage, a first spur gear on the upper end of said control shaft, a second spur gear meshing with said first spur gear and mounted on the control carriage for axial rotation about a second upright axis parallel to said first upright axis and spaced from a first side of said central vertical plane, a worm gear connected to said second spur gear in coaxial relation therewith for rotating the actuator shaft, and a wand connected to said control shaft for rotating the control shaft and for drawing the control carriage along the headrail, said plurality of slat carriages including a first group comprising a first lead slat carriage and a plurality of auxiliary slat carriages in said headrail intermediate said control carriage and one end of the headrail and a second group of slat carriages comprising a second lead slat carriage and a plurality of auxiliary slat carriages in said headrail intermediate a second side of said control carriage and a second end of said headrail, said carriage traverse means including means connecting the first lead slat carriage to said control carriage for movement thereby; first and second cord return means at said first and second ends of the headrail and traverse cord means arranged in a loop having cord runs extending between said first and second cord return means at opposite sides of the central vertical plane, means connecting one run of said cord means to said control carriage and means connecting the other run of said traverse cord means to the second lead carriage such that the second lead carriage is drawn in a direction away from the second end of the headrail when the control carriage is moved away from said one end of the headrail and the second lead carriage is drawn by the cord means in a direction toward the second end of the headrail when the control carriage is moved toward the first end of the headrail.

6. A vertical blind apparatus according to claim 5 wherein said auxiliary slat carriages each have cord passages therethrough at opposite sides of said central vertical plane, one run of said cord means extending through the cord passages in said auxiliary carriages at one side of the central vertical plane and the other run of the cord means extending through the cord passages in the auxiliary slat carriages at the other side of the central vertical plane.

7. A vertical blind apparatus including an elongated headrail having lengthwise extending sidewalls spaced substantially equidistant from a central vertical plane and guide rails on the sidewalls, a horizontally extending actuator shaft rotatably mounted on the headrail with its axis in said central vertical plane, a plurality of slat carriages mounted on the guide rails for movement therealong and a slat carrier mounted on each slat carriage for turning relative thereto about a vertical axis disposed in said central vertical plane, means on the slat carriage for turning the slat carriers in response to turning of the actuator shaft, operating means for traversing the slat carriages along the headrail and for turning the slat carriers, the operating means including a control carriage mounted on the guide rails for movement along the headrail and having a control shaft mounted thereon for rotation about a first upright axis disposed in said central vertical plane, carriage traverse means for traversing the slat carriages along the headrail in response to movement of the control carriage, a first spur gear on the upper end of said control shaft, second and third spur gears meshing with said first spur gear and mounted on the control carriage for axial rotation about respective second and third upright axes parallel to said first upright axis and spaced respectively from first and second sides of said central vertical plane, first and second worm gears respectively connected to said second and third spur gears in coaxial relation therewith and spaced from said first and second sides of said central vertical plane, said first and second worm gears having threads of opposite hand for rotating the actuator shaft, and a wand connected to said control shaft for rotating the control shaft and for drawing the control carriage along the headrail.

8. A vertical blind apparatus according to claim 7 wherein said actuator shaft has external splines defining longitudinally extending gear teeth, said first and second worm gears meshing with the gear teeth on the actuator shaft.

9. A vertical blind apparatus according to claim 7 including a first slip clutch means for drivingly connecting said second spur gear to said first worm gear and a second slip clutch means for drivingly connecting the third spur gear to the second worm gear.

10. A vertical blind apparatus according to claim 9 wherein said first and second slip-clutch means each includes a pocket of non-circular cross-section in each worm gear and a stem of non-circular cross-section on the second and third spur gears extending into the socket on the associated worm gear.

11. A vertical blind apparatus including an elongated headrail having lengthwise extending sidewalls spaced substantially equidistant from a central vertical plane and guide rails on the sidewalls, a horizontally extending actuator shaft rotatably mounted on the headrail with its axis in said central vertical plane, a plurality of slat carriages mounted on the guide rails for movement therealong and a slat carrier mounted on each slat carriage for turning relative thereto about a vertical axis disposed in said central vertical plane, means on the slat carriage for turning the slat carriers in response to turning of the actuator shaft, operating means for traversing the slat carriages along the headrail and for turning the slat carriers, the operating means including a control carriage mounted on the guide rails for movement along the headrail and having a control shaft mounted thereon for rotation about a first upright axis disposed in said central vertical plane, carriage traverse means for traversing the slat carriages along the headrail in response to movement of the control carriage, a first spur gear on the upper end of said control shaft, second and third spur gears meshing with said first spur gear and mounted on the control carriage for axial rotation about respective second and third upright axes parallel to said first upright axis and spaced respectively from first and second sides of said central vertical plane, first and second worm gears respectively connected to said second and third spur gears in coaxial relation therewith and spaced from said first and second sides of said central vertical plane, said first and second worm gears having threads of opposite hand for rotating the actuator shaft, and a wand connected to said control shaft for rotating the control shaft and for drawing the control carriage along the headrail, said plurality of slat carriages including a first group comprising a first lead slat carriage and a plurality of auxiliary slat carriages in said headrail intermediate said control carriage and one end of the headrail and a second group of slat carriages comprising a second lead slat carriage and a plurality of auxiliary slat carriages in said headrail intermediate a second side of said control carriage and a second end of said headrail, said carriage traverse means including means connecting the first lead slat carriage to said control carriage for movement thereby; first and second cord return means at said first and second ends of the headrail and traverse cord means arranged in a loop having cord runs extending between said first and second cord return means at opposite sides of the central vertical plane, means connecting one run of said cord means to said control carriage and means connecting the other run of said traverse cord means to the second lead carriage such that the second lead carriage is drawn in a direction away from the second end of the headrail when the control carriage is moved away from said one end of the headrail and the second lead carriage is drawn by the cord means in a direction toward the second end of the headrail when the control carriage is moved toward the first end of the headrail.

12. A vertical blind apparatus according to claim 11 wherein said auxiliary slat carriages each have cord passages therethrough at opposite sides of said central vertical plane, one run of said cord means extending through the cord passages in said auxiliary carriages at one side of the central vertical plane and the other run of the cord means extending through the cord passages in the auxiliary slat carriages at the other side of the central vertical plane.

13. A vertical blind apparatus including an elongated headrail having lengthwise extending sidewalls spaced substantially equidistant from a central vertical plane and guide rails on the sidewalls, a horizontally extending actuator shaft means rotatable mounted on the headrail with its axis in said central vertical plane, a plurality of slat carriages mounted on the guide rails for movement therealong and a slat carrier mounted on each slat carriage for turning relative thereto about a vertical axis disposed in said central vertical plane, means on the slat carriages for turning the slat carriers in response to turning of the actuator shaft, operating means for traversing the slat carriages along the headrail and for turning the slat carriers, the operating means including a control carriage mounted on the guide rails for movement along the headrail and having a control shaft mounted thereon for rotation about a first upright axis disposed in said central vertical plane, carriage traverse means for traversing the slat carriages along the headrail in response to movement of the control carriage, a first spur gear on the upper end of said control shaft, a second spur gear meshing with said first spur gear and mounted on the control carriage for axial rotation about a second upright axis parallel to said first upright axis and spaced from a first side of said central vertical plane, a worm gear connected to said second spur gear in coaxial relation therewith for rotating the actuator shaft, and a wand connected to said control shaft for rotating the control shaft for drawing the control carriage along the headrail, said carriage traverse means including means attaching a lead one of the slat carriages alongside the control carriage for movement therewith.

14. A vertical blind apparatus including an elongated headrail having lengthwise extending sidewalls spaced substantially equidistant from a central vertical plane and guide rails on the sidewalls, a horizontally extending actuator shaft rotatable mounted on the headrail with its axis in said central vertical plane, a plurality of slat carriages mounted on the guide rails for movement therealong and a slot carrier mounted on each slat carriage for turning relative thereto about a vertical axis disposed in said central vertical plane, means on the slat carriage for turning the slat carriers in response to turning of the actuator shaft, operating means for traversing the slat carriages along the headrail and for turning the slat carriers, the operating means including a control carriage mounted on the guide rails for movement along the headrail and having a control shaft mounted thereon for rotation about a first upright axis disposed in said central vertical plane, carriage traverse means for traversing the slat carriages along the headrail in response to movement of the control carriage, a first spur gear on the upper end of said control shaft, second and third spur gears meshing with said first spur gear and mounted on the control carriage for axial rotation about respective second and third upright axes parallel to said first upright axis and spaced respectively from first and second sides of said central vertical plane, first and second worm gears respectively connected to said second and third spur gears in coaxial relation therewith and spaced from said first and second sides of said central vertical plane, said first and second worm gears having threads of opposite hand for rotating the actuator shaft, and a wand connected to said control shaft for rotating the control shaft and for drawing the control carriage along the headrail, said carriage traverse means including means attaching a lead one of the slat carriages alongside the control carriage for movement therewith.

* * * * *